US008549983B2

(12) United States Patent
Brahmer

(10) Patent No.: US 8,549,983 B2
(45) Date of Patent: Oct. 8, 2013

(54) HYDRAULIC DRIVE, IN PARTICULAR FOR MACHINE TOOLS, AND METHOD FOR CONTROLLING THE HYDRAULIC DRIVE

(75) Inventor: Bert Brahmer, Bruchsal (DE)

(73) Assignee: Voith Patent GmbH, Heidenheim (DE)

( * ) Notice: Subject to any disclaimer, the term of this patent is extended or adjusted under 35 U.S.C. 154(b) by 901 days.

(21) Appl. No.: 12/450,545

(22) PCT Filed: May 31, 2008

(86) PCT No.: PCT/EP2008/004349

§ 371 (c)(1),
(2), (4) Date: Feb. 12, 2010

(87) PCT Pub. No.: WO2008/151732

PCT Pub. Date: Dec. 18, 2008

(65) Prior Publication Data

US 2010/0132349 A1 Jun. 3, 2010

(30) Foreign Application Priority Data

Jun. 12, 2007 (DE) ..... 10 2007 027 603

(51) Int. Cl.
*F15B 11/044* (2006.01)
*B30B 15/16* (2006.01)

(52) U.S. Cl.
USPC ..... 91/420; 91/443

(58) Field of Classification Search
USPC ..... 91/420, 426, 443; 100/269.14, 269.16
See application file for complete search history.

(56) References Cited

U.S. PATENT DOCUMENTS 4,531,449 A * 7/1985 Reith ..... 91/420
7,194,947 B2 * 3/2007 Mentink ..... 91/420

FOREIGN PATENT DOCUMENTS

| | | |
|---|---|---|
| DE | 19608582 | 9/1997 |
| EP | 0676547 | 10/1995 |
| EP | 1484209 | 12/2004 |
| WO | WO 2004/099626 A | 11/2004 |

OTHER PUBLICATIONS

The State Intellectual Property Office of the People's Republic of China; The Fourth Office Action dated Apr. 2, 2013 for Application No. 200880019698.4.

* cited by examiner

*Primary Examiner* — Thomas E Lazo
(74) *Attorney, Agent, or Firm* — Farjami & Farjami LLP

(57) ABSTRACT

Provided is a hydraulic drive including a double-acting work cylinder with a piston having a first working surface effective in a retracting direction and a second working surface effective in an extending direction, wherein the first working surface delimits a first pressure chamber and the second working surface delimits a second pressure chamber, at least two different pressures being applicable to at least one of the first working surface and the second working surface for retracting or extending the piston into and out of the work cylinder, an actuator unit which optionally enables a throttled return flow of a hydraulic medium from the first pressure chamber delimited by the first working surface, and control means for triggering the actuator unit in such a way prior to a sudden acceleration of the piston due to a sudden force release.

13 Claims, 5 Drawing Sheets

HYDRAULIC DRIVE, IN PARTICULAR FOR MACHINE TOOLS, AND METHOD FOR CONTROLLING THE HYDRAULIC DRIVE

This is a U.S. national phase application which is based on, and claims priority from PCT application Serial No. PCT/EP2008/004349, filed on May 31, 2008, which claims priority from foreign application Serial No. DE 102007027603.8, filed on Jun. 12, 2007 in Germany.

The invention relates to a hydraulic drive, especially for machine tools, e.g. for a press, punching machine, nibbling machine and the like, according to the preamble of claim 1, and a method for controlling the hydraulic drive according to the preamble of claim 12.

Hydraulic drives for machine tools are known to the person skilled in the art. FIGS. 1, 2 and 4 relate to previously used arrangements.

FIG. 1 shows the principal device configuration of a conventional hydraulic drive for a punching machine. In the conventional arrangement as shown in FIG. 1, a pressure supply device comprises a fixed displacement pump 1.1 for generating and operating pressure and a first pressure control valve 1.2 which can be adjusted to a desired output pressure range. A first hydraulic reservoir 1.3 is switched into the supply network. The volume flow in the supply network can be increased briefly through its use.

A first pressure chamber 1.8 in the work cylinder 1.5 of the drive is always connected via the first line B with the pressure source, whereas a second pressure chamber 1.7 in the work cylinder 1.5 can be connected by means of a three-way valve optionally with the pressure source or a tank 1.9. The two pressure chambers 1.7, 1.8 are separated from one another by the piston 1.6 of the work cylinder 1.5, with the surface area on the piston 1.6 which is pressurized from the first pressure chamber 1.8 being smaller than the surface area of the piston 1.6 which is pressurized from pressure from the second pressure chamber 1.7 as a result of the single-sided piston rod.

The extension of the piston 1.6 or the piston rod which is connected with the same occurs by connecting the second pressure chamber 1.7 with the pressure source, with the maximum outlet force being determined by the surface ratio of the two mentioned surface areas of piston 1.6 which delimit the pressure chambers 1.7, 1.8 and are opposite of each other. By extending the piston 1.6, the punching tool (not shown) is moved towards the workpiece (not shown) and is then moved further.

As a result of the resistance that the workpiece offers to the piston movement, the piston 1.6 is braked at first, and the pressure necessary for the required cutting force builds up in the second pressure chamber 1.7. According to the modulus of elasticity of the hydraulic oil in the second pressure chamber 1.7, spring energy is stored in the oil column in the second pressure chamber 1.7, which means the oil column is pretensioned.

When the workpiece breaks, there is a sudden release of force of the piston 1.6 and consequently there will be its explosive acceleration in the direction of extension. The oil in the first pressure chamber 1.8 is ejected from the first pressure chamber 1.8 by the piston 1.6 which is ejected in the direction of extension and pressed via line B in the direction towards reservoir 1.4, with simultaneous expansion of the oil column into the second pressure chamber 1.7 which accelerates the piston 1.6. At this point in time, the three-way valve 1.4 must be changed over as quickly as possible for the return stroke of the piston 1.6, thus leading to an interruption in the oil supply in the second line A which is connected with the second pressure chamber 1.7. When this interruption coincides temporally with the increased extension speed of the piston 1.6 as a result of the so-called cutting impact, negative pressures will occur in the second line A which lead on their part to disturbing noises and to cavitation at the control edges or the housing of the three-way valve 1.4.

FIG. 2 shows the principal device configuration of a further hydraulic drive similar to the one of FIG. 1, but with a 4/3-way valve 2.1 instead of the three-way valve (3/3-way valve) 1.4 of FIG. 1. This 4/3-way valve can also be arranged as a continuous action valve or switching valve. Departing from the embodiment as shown in FIG. 1, no constant pressure is exerted by the pressure source on first line B and thus the first pressure chamber 1.8, but the first pressure chamber 1.8 is always connected with the pressure source when the second pressure chamber 1.7 is connected with the tank 1.9, and connected with the tank 1.9 when the second pressure chamber 1.7 is connected with the pressure source. In the middle position of the 4/3-way valve 2.1, the two pressure chambers 1.7, 1.8 are separated both from the pressure source as well as the tank 1.9, whereas according to FIG. 1 only the second pressure chamber 1.7 is separated both from the pressure source as the tank 1.9 in the middle position of the three-way valve 1.4.

The embodiment shown in FIG. 2 is based on the same problems as were illustrated in connection with the embodiment according to FIG. 1.

FIG. 4 shows a path-time diagram of piston 1.6 of the conventional hydraulic drive of FIG. 1. TOS ("top of sheet") designates the upper side of the workpiece which concerns a sheet. Accordingly, BOS ("bottom of sheet") designates the bottom side of the workpiece. The piston is located at first in the upper dead center TDC ("top dead center"). Equilibrium pressure $p_0$ prevails in the second pressure chamber 1.7. A pressure prevails during the extension of the piston 1.6 with the prestroke speed 4.3 which is slightly larger than the equilibrium pressure.

Once the piston 1.6 reaches the workpiece, the piston 1.6 is braked, as explained above, and accelerated very strongly during the breakage of the workpiece by the pretensioned oil column in the second pressure chamber 1.7, so that a cutting speed 4.4 is temporarily obtained which is a multiple of the prestroke speed 4.3 or the return stroke speed 4.5 (cutting impact). When the oil replenishment is interrupted by the rerouted three-way valve, the pressure prevailing in the second line A drops up to cavitation, which can be recognized by the pressures around 0 bar (4.2), as indicated by the steep gradients 4.1.

The European patent application EP 0 676 547 A1 describes a flow control apparatus and a valve for a load-lowering brake with a measurement diaphragm through which a predetermined pressure difference is maintained and thus the speed of the adjustment of a hydraulic cylinder is kept constant. Once the pressure difference deviates from its predetermined value, a control piston which controls a flowing quantity of hydraulic fluid is displaced by changing the hydraulic fluid flow for such a time until the pressure difference about the measurement diaphragm is again close to its predetermined value.

EP 0 676 547 A1 thus discloses a quantity control apparatus which reacts to an undesirable volume flow of hydraulic medium resulting from the process in order to bring the volume flow back to the desired value.

Patent specification DE 196 08 582 B4 describes a hydro-compensator for smoothing the surge in the return line of a hydraulic system. A non-return valve and a nozzle switched in parallel thereto is provided in the return or tank line. The closing body of the non-return valve is pressed by a pressure spring against a seat. The force which the pressure spring exerts on the closing body corresponds to a specific pressure in the tank line section between a directional control valve and the non-return valve. The nozzle ensures that the pressure in the mentioned tank line section decreases to atmospheric pressure after a certain time. A dampener in the tank line is illustrated which responds again to changes of the pressure in the tank line.

The European patent application EP 1 484 209 A1 describes a hydraulic actuating apparatus, especially for a retractable hard-top of a convertible car. The actuating apparatus comprises a double-acting cylinder and a throttling device which is switched optionally to a throttled and non-throttled state. As long as the piston of the cylinder is actively extended by pressurization of a chamber in the cylinder, the throttling device is held in the non-throttled state. When the retractable hard-top pulls against the piston of the cylinder due to gravity and there is a likelihood that it might hit the windscreen, the speed of the piston is predetermined to be faster than through the pressurization, leading to a pressure loss in the cylinder chamber. A control piston determines this loss of pressure and switches the throttling device to the throttled state in response to this. The extension movement of the piston is thus braked.

In the solution described according to EP 1 484 209 A1, the hydraulic drive responds to an already occurred pressure drop in a chamber of a double-acting work cylinder, which means that an undesirable acceleration of the piston has already occurred. This would mean when using the mentioned drive in a machine tool that the disturbing noises and the cavitation would still occur.

The invention is based on the object of providing a hydraulic drive, especially for a machine tool such as a punching machine, a nibbling machine or a pressure in which the described disturbing noises and the cavitation have been eliminated or at least reduced.

Document WO 2004/099626 A1 describes a filling control apparatus for a double-acting cylinder with a first and second pressure chamber. A control piston is further provided which depending on the pressure on a first valve varies the flow cross section for returning hydraulic oil depending on the pressure in such a way that a reduction in the throttling is achieved at higher pressure.

The object in accordance with the invention is achieved by a hydraulic drive with the features of claim 1 and a method with the features of claim 12. Advantageous embodiments of the invention are defined in the dependent claims.

The hydraulic drive, which is provided especially for a press, a punching or nibbling machine, comprises a double-acting work cylinder whose piston comprises a first working surface effective in the move-in direction and a second working surface effective in the move-out direction. The working surfaces each delimit a pressure chamber. The two working surfaces are especially the two only working surfaces of the piston, which means the working cylinder has precisely two pressure chambers in this case. In order to move the piston into the work cylinder or out of the same, or to reverse the direction of piston stroke, at least two different pressures each can be applied to one or both working surfaces by means of an actuator. An embodiment is considered especially in this case as was already explained initially with respect to FIGS. 1 and 2, see there especially the inclusion of the 3/3-way valve between the pressure source, the tank and the second pressure chamber of the work cylinder in FIG. 1 or the 4/3-way valve between the pressure source, the tank and the two pressure chambers of the work cylinder in FIG. 2.

In accordance with the invention, an actuator unit is additionally provided in the hydraulic drive which enables a throttled return flow of hydraulic medium from the first pressure chamber which is delimited by the first working surface. The drive further comprises control means with which the actuator unit can be triggered prior to a sudden acceleration of the piston as a result of its sudden release of force that as a result of the throttling caused by the actuator unit there is a hydraulic damping of the movement of the piston.

The hydraulic drive in accordance with the invention or the method in accordance with the invention thus prevent the undesirable sudden acceleration of the piston by measures which are already taken as a precaution, which means the actuator unit causes a throttling of the return flow of hydraulic medium from the first pressure chamber already prior to a sudden acceleration of the piston. The drive advantageously does not react to a pressure drop in the second pressure chamber delimited by the second working surface, but instead switches the actuator unit, so that it causes a throttled return flow of hydraulic medium from the first pressure chamber delimited by the first working surface depending on a rise in pressure in the second pressure chamber delimited by the second working surface. Such an increase in pressure already occurs before the undesirable sudden acceleration of the piston due to its sudden release of force, so that the triggering in accordance with the invention occurs as a precaution or in a preventative way, in contrast to a subsequent braking of the already suddenly accelerated piston.

It is thus possible in accordance with the invention to avoid noises and cavitation before a situation occurs which gives rise to the likelihood of such noises and cavitations.

The actuator unit can cause the throttling of the hydraulic medium flowing out of the first pressure chamber according to a first embodiment, which means having a throttling point (with constant or controllable flow cross section) which is optionally switched into the flow path or out of the same, or which is arranged permanently in the flow path and whose flow cross section is changed or changeable optionally between a throttling position and a non-throttling or substantially non-throttling position.

According to a second embodiment, the actuator unit causes the throttling indirectly, which means it is switched parallel to a throttle concerning the hydraulic medium flow (with constant or controllable flow cross section) and optionally releases or blocks (partly or completely) an additional flow cross section in a bypass line to the throttle.

The outflow of hydraulic medium from the first pressure chamber which occurs directly or indirectly in an optional throttling manner, which means the flow as a result of displacement by the extending piston occurs in the direction of the pressure supply for example, especially by means of a pump and/or a pressure reservoir, by means of which the first pressure chamber is advantageously connected permanently, especially as in FIG. 1, or optionally, especially as in FIG. 2.

The actuator unit can principally be arranged in any possible suitable way. For example, the actuator unit comprises a flow control valve (and also flow valve or throttle valve) which is arranged in a first line or in a bypass line parallel to the same, through which hydraulic medium can flow off from the first pressure chamber.

The flow control valve concerns a control valve, a directional control valve or a throttling point with constant cross section. It is understood that principally other suitable flow control valves can be considered.

For example, the actuator unit concerns a 2/2-way valve which allows passage in a first switching position and blocks in a second position, when arranged in the said bypass line about a throttling point in the first line.

As an alternative to this, a 2/2-way valve can be directly arranged in the mentioned first line through which hydraulic medium can flow off from the first pressure chamber and have two switching positions, with the flow resistance by the 2/2-way valve in the first switching position is lower than in the second switching position.

According to one embodiment of the invention, the actuator unit (in the first line or parallel to a throttling point in the first line) is configured in such a way that it can be brought to the pass-through position or the blocking position or in the non-throttled position or the throttling position depending on the ratio of the supply pressure to the pressure $p_A$ which prevails in the second pressure chamber delimited by the second working surface. In one embodiment with pressures switched in an alternating manner in both pressure chambers of the work cylinder, as is shown in FIG. 2 for example, the switching of the actuator unit can also occur depending on the ratio of the pressures in the two pressure chambers.

According to an embodiment of the invention, a first control surface of the actuator unit can be supplied with the supply pressure or the pressure from the first pressure chamber, whereas the second control surface of the actuator unit can be supplied with the pressure $p_A$ in the second pressure chamber, with the actuator unit being brought to the pass-through position or blocking position or the non-throttled position or throttling position depending on the ratio of the pressure exerted on the first control surface to the pressure exerted on the second control surface.

For example, the work cylinder is arranged as a differential cylinder, which means only one side of the piston is provided with a piston rod, through which the piston has two differently large effective surfaces which are supplied with pressure from one pressure chamber each.

According to one embodiment of the invention, the second pressure chamber can optionally be supplied by means of the actuator with a supply pressure or tank pressure for extending or retracting the piston, whereas the first pressure chamber is supplied continually with supply pressure.

According to an alternative embodiment, the second pressure chamber can be connected with a low-pressure source, a high-pressure source or the tank, while the first pressure chamber is always connected with the low-pressure source.

According to a further embodiment, the first pressure chamber and the second pressure chamber can each optionally be connected with a pressure source or tank, and can especially be separated from the two, with the first pressure chamber always being connected with the pressure source in an embodiment with a 4/3-way valve (as shown in FIG. 2) when the second pressure chamber is connected with the tank and vice-versa.

The actuator concerns a continuously adjustable valve, a servo valve with electric actuation or a linear amplifier or a copying valve with mechanical return of the position of the piston in the work cylinder for example.

As a result of the invention, the noise during the punching through or the like of the workpiece (cutting impact) can be dampened to a considerable extent. Moreover, the risk of cavitation is considerably removed.

An embodiment of the invention is explained below in closer detail by reference to the enclosed drawings, wherein.

Figure 1:
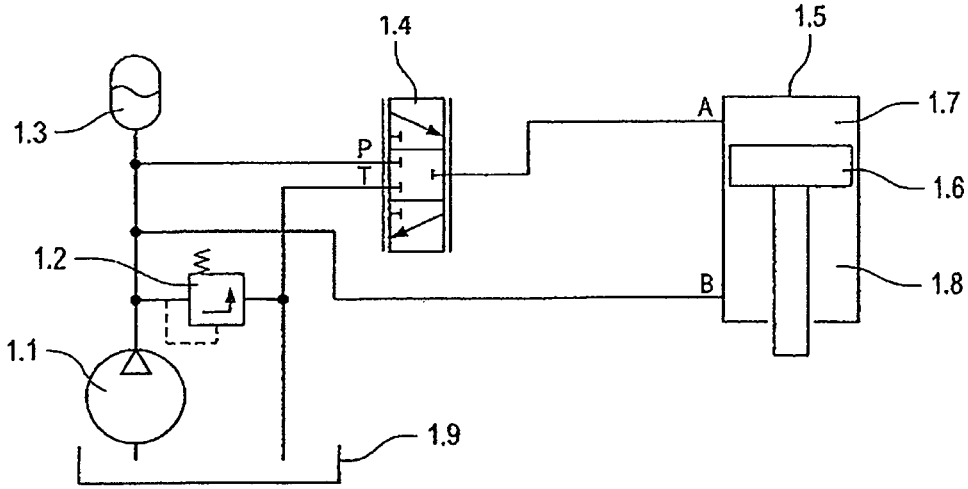
Fig.1 (PRIOR ART)
FIG. 1 shows the principal device configuration of a hydraulic drive according to the state of the art.
Figure 2:
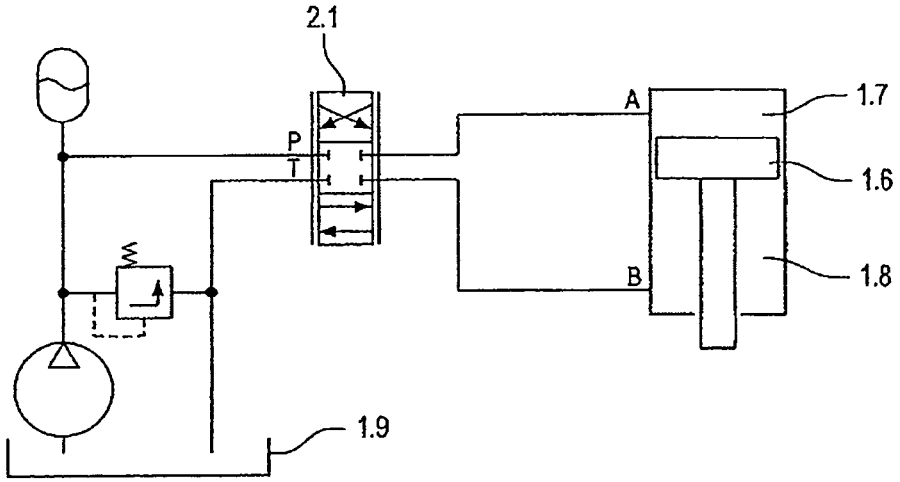
Fig.2 (PRIOR ART)
FIG. 2 shows the principal device configuration of a further conventional hydraulic drive.
Figure 3:
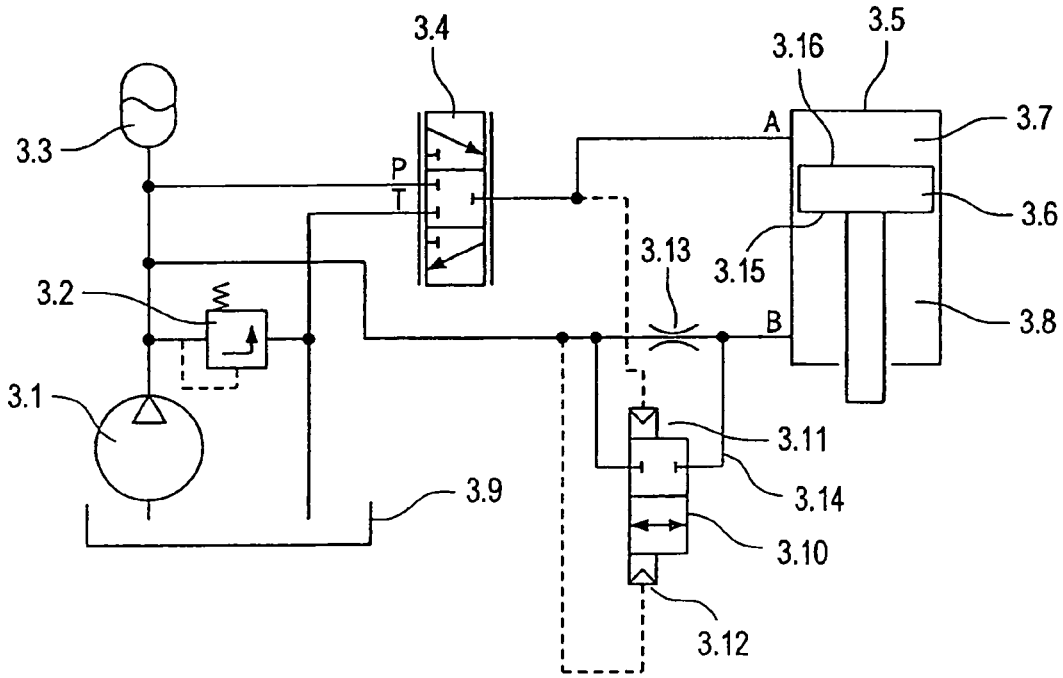
FIG. 3 shows the principal device configuration of a hydraulic drive in accordance with the invention.

The hydraulic drive in accordance with the invention which is shown principally and schematically in FIG. 3 comprises a fixed displacement pump 3.1 according to the embodiments as shown in FIGS. 1 and 2 for generating an operating pressure and a pressure control valve 3.2 which is adjustable to a desired initial pressure range. A hydraulic reservoir 3.3 is switched into the supply network, through which the volume flow in the supply network can be increased briefly. The pressure supply can also have a storage charge instead of the pressure control valve 3.2. Furthermore, a control pump with controllable pumping power can be provided instead of the fixed displacement pump 3.1 or in addition to the same.

The operating pressure acts via the first line B on the annular first working surface 3.15 of the piston 3.6 and exerts on the latter a constant force over time which acts in the move-in direction. By respective triggering of the directional control valve 3.4, especially the continuous action valve, the second working surface 3.16 of the piston 3.6 which is opposite of the first working surface 3.15 can be switched to tank, thus leading to a resulting force in the move-in direction which acts upon the piston and thus moves back the piston 3.6. When the connection P is switched with supply pressure of the pressure source via the second pressure chamber 3.7 to the second working surface 3.16, the piston 3.6 extends. The maximum force is defined by the ratio of the second working surface 3.16 to the first working surface 3.15.

The maximum extension force can be increased by maintaining a high overall efficiency in such a way for example that an additional supply pressure (high pressure "HD") is provided which is higher than the primarily applied supply pressure (low pressure "ND". This high pressure can be added in different ways, e.g. depending on the load. For example, adding high-pressure could be used as is known from the documents DE 10 2004 024 126 A1 and EP 1 138 958 B1.

A controllable throttle valve or, as is the case here, a constant throttle 3.13 is arranged in the first line B, through which the hydraulic medium which is displaced by the extending piston 3.6 can flow off from the first pressure chamber 3.8 delimited by the first working surface 3.15. The throttle 3.13 is bypassed by a bypass line 3.14 which opens into the first line B on both sides of the throttle 3.13. A 2/2-way valve 3.10 is arranged in the bypass line 3.14 as a proper actuator unit, with which the flow of the hydraulic medium through the bypass line 3.14 can optionally be allowed to pass through or be blocked.

The 2/2-way valve 3.10 is actuated hydraulically in this case. For this purpose, a first control surface 3.12 of the 2/2-way valve 3.10 is supplied with the supply pressure p and a second control surface 3.11 of the 2/2-way valve 3.10 is supplied with the pressure $p_A$ prevailing in the second pressure chamber 3.7 or in the second line A behind the directional control valve 3.4. In operation with low loading forces, the pressure in the second line A or in the second pressure chamber 3.7 is always considerably lower according to the surface ratio of the two working surfaces 3.15 and 3.16 than the pressure in the first line B and in the first pressure chamber 3.8 or, than the supply pressure p which prevails there in the illustrated connection of the control pressure line for the actuator unit (2/2-way valve 3.10) before the throttle 3.13. It follows from this that the 2/2-way valve in operation with low loading forces is always in the pass-through position, so that in this case the first pressure chamber 3.8 is in flow connection with the pressure source (supply pressure p) via the summation cross section (sums of the cross sections of the throttle 3.13 and the 2/2-way valve 3.10).

When the piston 3.6 or a punching tool which is connected to the same meets the workpiece and is braked as a result of this, the pressure rises in the second pressure chamber 3.7 which is delimited from the second working surface 3.16, as already mentioned above under FIG. 1. The ratio of the second control surface 3.11 to the first control surface 3.12 of the 2/2-way valve 3.10 can now be determined in such a way that the 2/2-way valve is brought to the blocked position upon exceeding a selectable critical maximum value of the pressure prevailing in the second pressure chamber 3.7, in which the hydraulic medium which is displaced by the extending piston 3.6 is allowed to flow off via throttle 3.13 from the first pressure chamber 3.8. The acceleration of the piston 3.6 which occurs during the impact cutting is now dampened by the throttling effect by throttle 3.13, through which the maximum achievable piston extension speed is reduced. The directional control valve 3.4 can thus be changed over for reversing the direction of piston movement without the likelihood of producing a negative pressure in the second line A. Once the counter-force acting on the piston drops after the breakage of the workpiece, the pressure also decreases in the second pressure chamber 3.7 and in the second line A to which the control pressure line of the 2/2-way valve 3.10 is connected, so that the 2/2-way valve 3.10 is automatically switched again to the pass-through position.

As a result of the constructional choice of the surface ratio of the control surfaces 3.11 and 3.12 of the actuator unit, the changeover threshold between throttled position and non-throttled position can be determined to be any desired pressure ratio between the pressures in the lines A and B and thus to any desired working force of the piston. In the case of systems with several operating pressures (especially high pressure and low pressure), this changeover threshold is advantageously set to a value slightly beneath the maximum value of the working force in the first pressure stage (ND).

A controllable throttle valve can be provided instead of a constant throttle 3.13 in the first line B. Alternatively, the throttle 13 can be replaced by a directional control valve, especially a 2/2-way valve, which has a non-throttled passage in the first switching position and a throttled passage in the second switching position. Said 2/2-way valve (not shown) can be triggered like the 2/2-way valve 3.10 of FIG. 3 in order to optionally enable, in accordance with the invention, a throttled return flow of hydraulic medium from the first pressure chamber 3.8 delimited by the first working surface 3.15, which always occurs during or before a sudden acceleration of the piston 3.6 as a result of its sudden force release. In the other operating states, a comparatively non-throttled return flow of hydraulic medium can be provided from the first pressure chamber 3.8 or into the first pressure chamber 3.8, the latter in the case of a retracting movement of the piston 3.6, especially by automatic switching or holding the 2/2-way valve 3.10 according to FIG. 3 or a 2/2-way valve with throttled pass-through position instead of throttle 3.13 when there is a lower pressure in the second pressure chamber 3.7 or second line A than in the first pressure chamber 3.9 or first line B, or, in the illustrated connection of the control pressure line to the control surface 3.12 of the 2/2-way valve 3.10 (as seen from the pressure source) before the throttle 3.13, when the pressure in the second pressure chamber 3.7 or in the second line A exceeds the supply pressure p.

Figure 4:
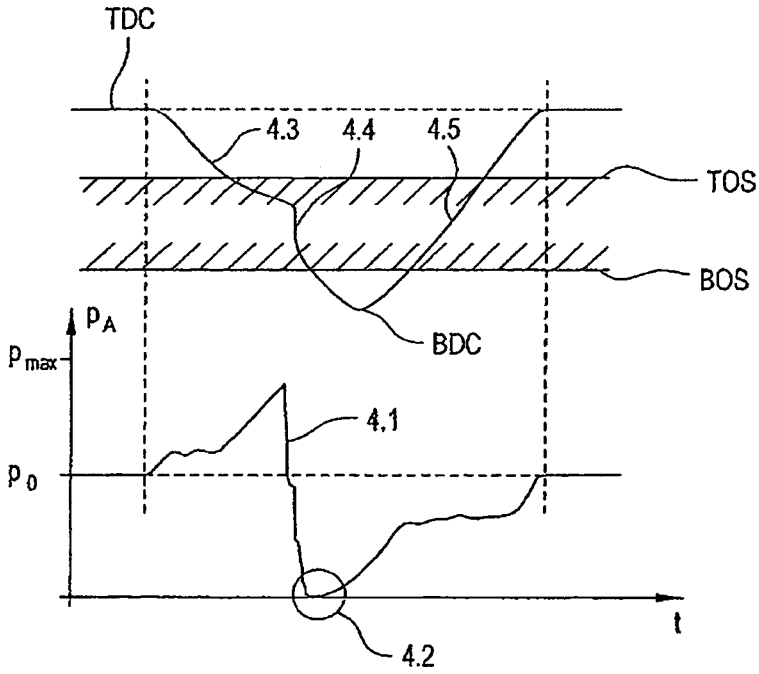
Fig.4 (PRIOR ART)
FIG. 4 shows a path-time diagram of the piston of the conventional hydraulic drive of FIG. 1.
Figure 5:
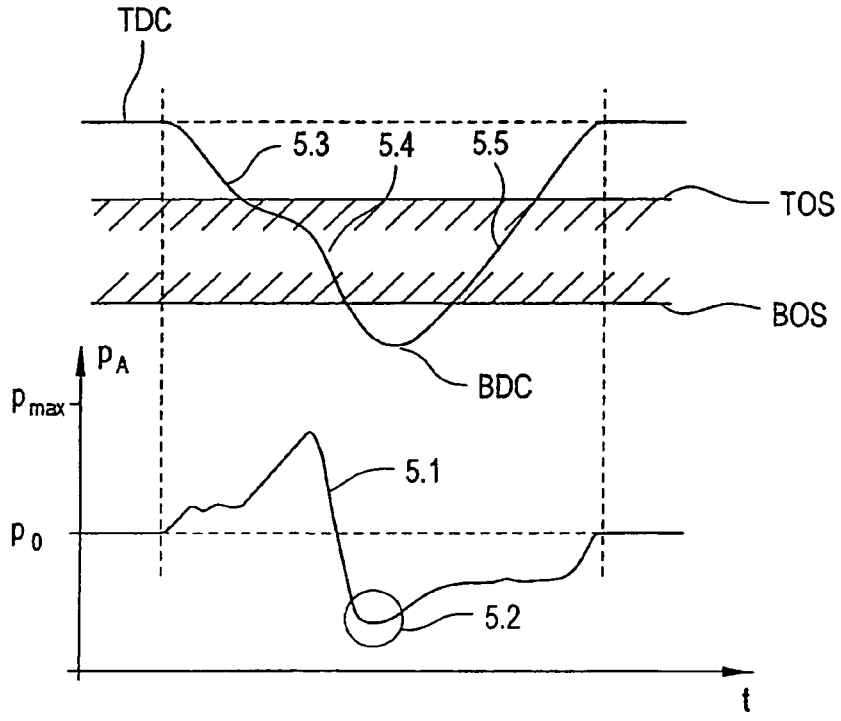
FIG. 5 shows a path-time diagram of the piston of the hydraulic drive of FIG. 3 in accordance with the invention.

In FIG. 5, which relates to the hydraulic drive of FIG. 3 in accordance with the invention, the time progression of the path of the piston 3.6 and the pressure $p_A$ prevailing in the second pressure chamber 3.7 is shown graphically. As a result of the pressure rise in the second pressure chamber 3.7, the 2/2-way valve 3.10 is brought to the blocked position. After the breakage of the workpiece, the piston 3.6 is accelerated to an only very low speed 5.4 as a result of the throttling effect. The pressure gradient 5.1 is considerably flatter in comparison with FIG. 4 and the pressure $p_A$ remains above the range of cavitation.

The invention claimed is:

1. A hydraulic drive comprising:

a double-acting work cylinder with a piston having a first working surface effective in a retracting direction and a second working surface effective in an extending direction, wherein the first working surface delimits a first pressure chamber and the second working surface delimits a second pressure chamber;

at least two different pressures being applicable to at least one of the first working surface and the second working surface for retracting or extending the piston into and out of the work cylinder;

an actuator unit which optionally enables a throttled return flow of a hydraulic medium from the first pressure chamber delimited by the first working surface;

control means for triggering the actuator unit in such a way prior to a sudden acceleration of the piston due to a sudden force release that there is a hydraulic damping of a movement of the piston as a result of a throttled return flow of the hydraulic medium from the first pressure chamber caused by the actuator unit directly or indirectly;

wherein the actuator unit switches to the second pressure chamber delimited by the second working surface depending on a pressure rise so that the same causes a throttled return flow of the hydraulic medium from the first pressure chamber delimited by the first working surface; and wherein the actuator unit comprises a throttle valve arranged in a first line through which the hydraulic medium can flow off from the first pressure chamber, the actuator unit comprises at least two switching position, wherein in a first switching position the throttling of the return flow of hydraulic medium from the first pressure chamber is achieved and in a second switching Position a comparatively lower throttling or substantially throttle-free return flow or inflow of the hydraulic medium from the first pressure chamber or into the first pressure chamber is achieved.

2. The hydraulic drive according to claim 1, wherein the actuator unit is arranged as a 2/2-way valve, wherein the actuator unit is embedded in the hydraulic drive so that the actuator unit is brought into the first switching position with throttling or the second switching position with reduced throttling depending on a ratio of supply pressure of a pressure source to a pressure $p_A$ which prevails in the second pressure chamber delimited by the second working surface.

3. The hydraulic drive according to claim 1, wherein the work cylinder is arranged as a differential cylinder.

4. The hydraulic drive according to claim 1, wherein the second pressure chamber can be supplied with a supply pressure or a tank pressure by means of the actuator unit for extending or retracting the piston and the first pressure chamber is continuously supplied with a supply pressure in the case of the throttle-free return flow of hydraulic medium from the same.

5. The hydraulic drive according to claim 1, wherein the second pressure chamber can be connected with a low-pressure source, a high-pressure source or a tank pressure, and the first pressure chamber is always connected with the low-pressure source.

6. The hydraulic drive according to claim 1, wherein the second pressure chamber and the first pressure chamber can be subjected to a supply pressure or a tank pressure by means of the actuator unit in an alternating manner for the extending or retracting the piston.

7. A hydraulic drive comprising:

a double-acting work cylinder with a piston having a first working surface effective in a retracting direction and a second working surface effective in an extending direction, wherein the first working surface delimits a first pressure chamber and the second working surface delimits a second pressure chamber;

at least two different pressures being applicable to at least one of the first working surface and the second working surface for retracting or extending the piston into and out of the work cylinder;

an actuator unit which optionally enables a throttled return flow of a hydraulic medium from the first pressure chamber delimited by the first working surface;

control means for triggering the actuator unit in such a way prior to a sudden acceleration of the piston due to a sudden force release that there is a hydraulic damping of a movement of the piston as a result of a throttled return flow of the hydraulic medium from the first pressure chamber caused by the actuator unit directly or indirectly;

wherein the actuator unit switches to the second pressure chamber delimited by the second working surface depending on a pressure rise so that the same causes a throttled return flow of the hydraulic medium from the first pressure chamber delimited by the first working surface; and wherein a throttle is arranged in a first line through which hydraulic medium can flow off from the first pressure chamber, and the actuator unit, in the form of a directional control valve, is provided in a bypass line which is arranged parallel to the throttle in order to optionally open and close the bypass line.

8. The hydraulic drive according to claim 7, wherein the actuator unit is embedded in the hydraulic drive in such a way that the actuator unit is brought to a pass-through position or a blocked position depending on a ratio of a supply pressure of a pressure source to a pressure $p_A$ which prevails in the second pressure chamber which is delimited by the second working surface.

9. The hydraulic drive according to claim 7, wherein a first control surface of the actuator unit is subjected to the pressure of the first pressure chamber, a first line connected to the first pressure chamber or a supply pressure of a pressure source, and a second control surface of the actuator unit is subjected to the pressure of the second pressure chamber or a second line connected to the second pressure chamber, wherein the actuator unit is brought to a throttling position or a reduced throttling position or a pass-through position or a blocked position depending on a ratio of a first pressure exerted on the first control surface of the actuator unit and a second pressure exerted on the second control surface of the actuator unit.

10. A method for controlling a hydraulic drive, comprising:

a double-acting work cylinder with a piston having a first working surface effective in the retracting direction and a second working surface effective in an extending direction, wherein the first working surface delimits a first pressure chamber and a second working surface delimits a second pressure chamber, with at least two different pressures being applicable to at least one of the first working surfaces and the second working surface for retracting or extending the piston, wherein a return flow of hydraulic medium from the first pressure chamber delimited by the first working surface is throttled at an increased rate prior to a sudden acceleration of the piston as a result of the piston having a sudden force release, so that the extending motion of the piston is dampened hydraulically, wherein an actuator unit switches to the second pressure chamber delimited by the second working surface depending on a pressure rise so that the actuator unit causes a throttled return flow of hydraulic medium from the first pressure chamber delimited by the first working surface, and wherein the hydraulic medium from the first pressure chamber is throttled at the increased rate by a triggering or a switching of the actuator unit arranged in a first line, wherein hydraulic medium is discharged from the first pressure chamber, wherein the actuator unit is arranged as a throttle valve with a first switching position with a comparatively stronger throttling and a second switching position with a comparatively reduced throttling, and the increased throttling is caused by switching to the first switching position.

11. The method according to claim 10, wherein the increased throttling is caused by closing a bypass line which is arranged parallel to the throttle valve in the first line through which the hydraulic medium can flow off from the first pressure chamber and which bypasses the throttle valve.

12. The method according to claim 11, wherein the closing of the bypass line is effected by means of a second actuator unit, especially in the form of a 2/2-way valve, which is switched or controlled depending on a pressure ratio or a pressure difference between a pressure in the second pressure chamber or a second line connected to the the second pressure chamber and a pressure in the first pressure chamber, a first line connected to the first pressure chamber or a supply pressure.

13. The method according to claim 10, wherein the actuator unit is switched depending on a pressure ratio or a pressure difference between a pressure in the second pressure chamber or a second line connected to the second pressure chamber and a pressure in the first pressure chamber, a first line connected to the first pressure chamber or a supply pressure.

* * * * *